United States Patent [19]

Storz

[11] Patent Number: 5,069,442

[45] Date of Patent: Dec. 3, 1991

[54] TRANSPORT DEVICE FOR PAPER SHEETS OF VARYING OR DIFFERENT WIDTHS AND THICKNESS

[75] Inventor: Martin Storz, Villingen, Fed. Rep. of Germany

[73] Assignee: Mannesmann Aktiengesellschaft, Düsseldorf, Fed. Rep. of Germany

[21] Appl. No.: 630,869

[22] Filed: Dec. 20, 1990

[30] Foreign Application Priority Data

Dec. 22, 1989 [DE] Fed. Rep. of Germany ..... 3943227

[51] Int. Cl.[5] ..... B65H 9/16

[52] U.S. Cl. ..... 271/250; 271/272

[58] Field of Search ..... 271/248, 250, 251, 272–274; 400/636, 633, 579; 226/196, 190, 189, 187, 185

[56] References Cited

U.S. PATENT DOCUMENTS 4,056,263 11/1977 LaWhite et al. ..... 271/251 X 4,605,218 8/1986 Knepper et al. ..... 271/251 X

OTHER PUBLICATIONS

IBM Technical Disclosure Bulletin, vol. 20, No. 4, Sep. 1977, p. 1295, Aligning Sheet Feeder, R. A. Lamos.

*Primary Examiner*—David H. Bollinger

*Attorney, Agent, or Firm*—Cohen, Pontani & Lieberman

[57] ABSTRACT

A device for the transport of recording media (3) of varying or different widths and/or thicknesses while automatically aligning the same includes a rotatably mounted and driven friction roll (1) and a plurality of rotatable pressure rollers 2*a*, 2*b*, 2*c* arranged in abutment with the friction roll periphery. A guide surface (6) for one of the lateral edges (3*a*) of the recording medium, which surface extends perpendicular to the friction roll axis (5), is associated with one end (4) of the friction roll. The pressure rollers (2*a*, 2*b*, 2*c*) are located off-center with respect to the length (7) of the elongated friction roll on the side or section thereof closest to the guide surface (6), while the longitudinal section (8) of the friction roll (1) which is most remote from the guide surface (6) is free of pressure rollers. The spacing (10) between the guide surface (6) and that one of the pressure rollers (2*c*) located most remote from the guide surface is selected so as to be at no more than one-half of the minimum of recording media that are intended for use with the transport device.

22 Claims, 2 Drawing Sheets

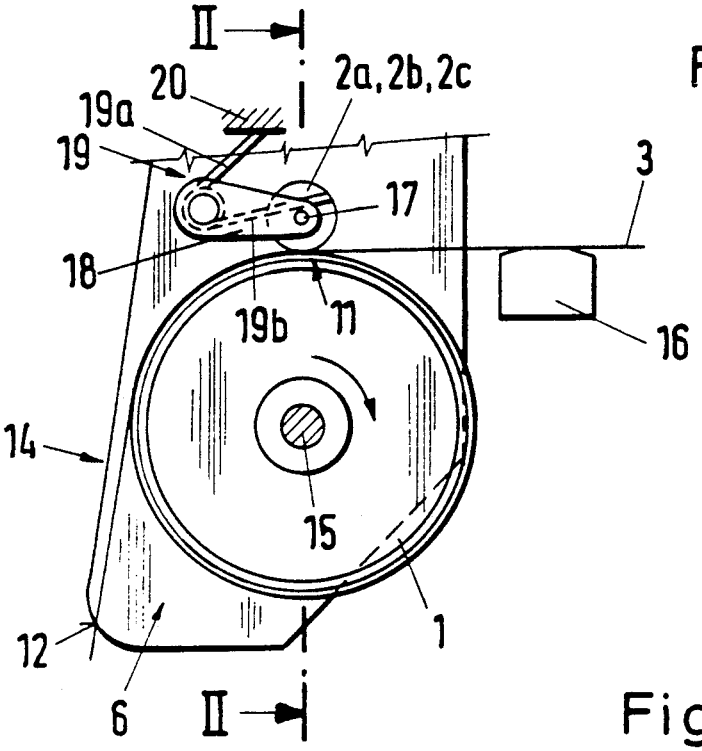
Fig.1
Fig.2
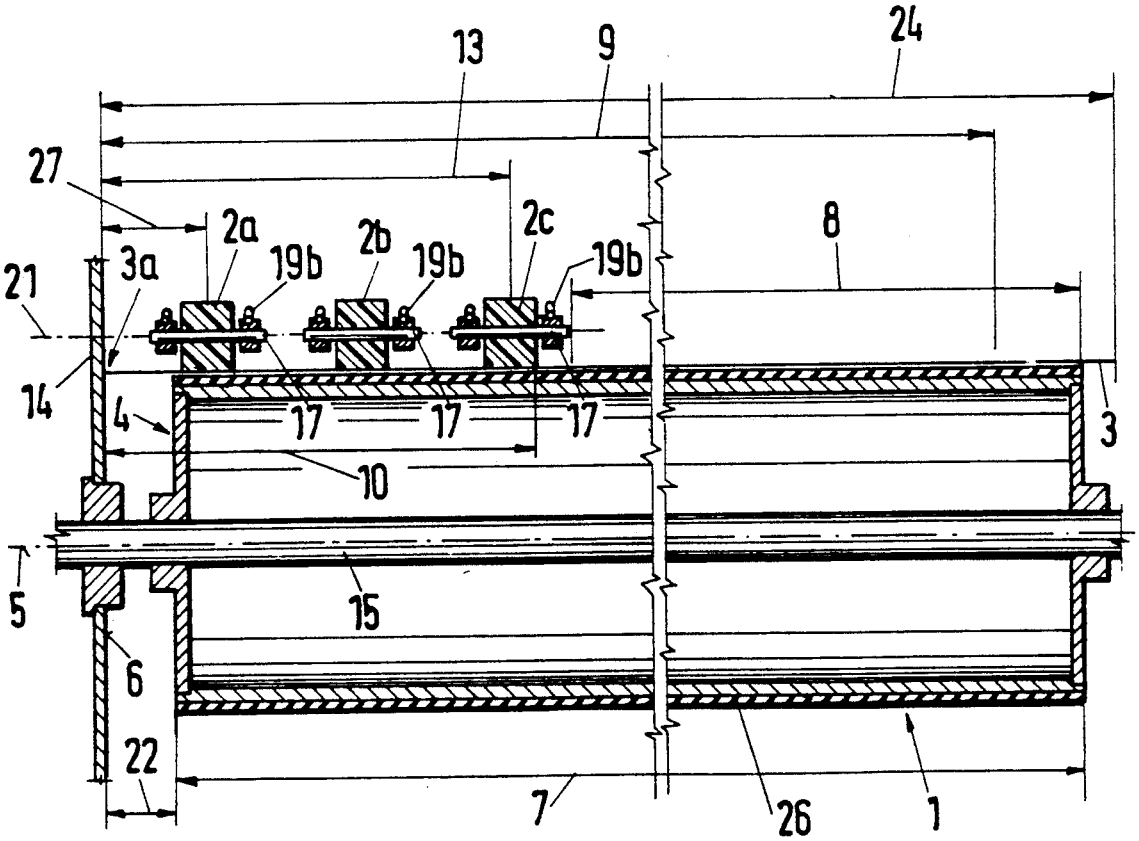

TRANSPORT DEVICE FOR PAPER SHEETS OF VARYING OR DIFFERENT WIDTHS AND THICKNESS

FIELD OF THE INVENTION

The present invention relates to a device for the transport of individual sheets or webs of paper of varying or different widths and/or thicknesses and, more particularly, to such a device which automatically positions or repositions a web in aligned condition along a guide surface or wall.

BACKGROUND OF THE INVENTION

It is known in the art to provide, in paper handling apparatus such as printers, web transport devices which include a rotatably mounted and driven friction roll and a plurality of rotatable pressure rollers arranged individually on and along the circumference of the friction roll. Such devices are commonly employed for the drawing in or pull-type feeding of a variety of typically paper-based documents or recording media as, for example, vouchers that are used in banks, industrial concerns, insurance companies and similar businesses. The device can, accordingly, form a part of a printer, a voucher processing device or any of a variety of other office machines.

It is also known, in devices of these types, to determine the lateral position of the recording medium by way of stops for contact with both of the opposed lateral edges of the paper or other recording medium. In constructions in which these stops are fixed in position, the device is suitable for only a single specific width of recording medium, the accuracy and position of the recording medium being decisively dependent on the tolerances of the recording medium width. These tolerances may easily, and commonly do, exceed 1% of the width of the recording medium due, at least in part, to both manufacturing tolerances and variations in temperature and humidity.

Where, on the other hand, one of the laterally-opposed stops is displaceable, several or a range of widths can be accomodated and processed through the apparatus. In such arrangements, however, certain difficulties nevertheless arise if a pressure roller should happen to lie on the side or lateral edge of the recording medium. In that case, the forces on the recording medium result in lateral travel or movement of the medium and thereby lead to disturbances in operation. Moreover, the provision of an adjustable stop means or element constitutes an additional expense in design and manufacture of the device. It must additionally be recognized that the operator must have the ability to suitably and correctly adjust the movable stop upon each and any change in width of the recording medium.

Still another difficulty arises where the recording medium or paper is initially inserted into the device in an oblique or unduly angled orientation; this further increases the danger that the edge of the recording medium will become damaged during feeding or transport and thereby negatively impact general operation of the device.

A second heretofore known effort to solve these problems lies in the provision of rubber-covered conical pressure rollers by means of which lateral components of movment of the recording medium are produced to move the medium along a reference edge. In this case, however, the frictional forces, and thus the transmission of force to the recording medium, must be via the pressure rollers and not (or only in part) via the underlying friction roll. As a consequence, the pressure rollers must also be driven which, as will be appreciated, adds substantial additional expense from a structural and manufacturing standpoint. Furthermore, in such constructions the adherence of the recording medium to the friction roll must be less than the medium's adherence to the driven pressure rollers in order to permit lateral movement of the recording medium during its transport.

In a third known arrangement for determining the lateral position of a transported recording medium, pressure rollers which are swingable through a sharply acute angle guide the recording medium along a reference edge. In this case the pressure rollers must be separately driven and covered with a rubber surface. These pressure rollers must also be swung or pivoted between two, relatively opposed positions for accomodating paper transport in either of two, e.g. forward and reverse, respective directions. Thus, this arrangement is also quite expensive to structurally implement and manufacture.

SUMMARY OF THE INVENTION

It is accordingly the desideratum of the present invention to provide a transport device for a paper processing machine or apparatus in which recording media of different or varying widths and/or thicknesses may be automatically directed into the desired lateral position and direction, even where the medium is introduced into the processing machine in an oblique orientation, and wherein the desired position and direction are maintained during the full transport or processing of the recording medium.

This and other objects are realized, in accordance with the present invention, by providing—in a paper transport device of the type generally currently known—a guide surface for one of the side or lateral edges of the paper. The guide surface extends perpendicular to the axis of an elongated friction roll and is proximately associated with one end of the friction roll. One or more pressure rollers are disposed in spring-loaded abutment with the friction roll periphery at locations longitudinally-offset along the friction roll on that longitudinal side of the friction roll which is closest to or towards the paper guide surface. That longitudinal side or part of the friction roll which is remote from the guide surface is free of pressure rollers. This arrangement of pressure rollers is further defined by the relationship that, for an intended minimum width of recording medium to be used with the transport device of the invention, that minimum width is equal to at least twice the distance from the paper guide surface to the last pressure roller—i.e. to that pressure roller located most remote from the guide surface. Put another way, the distance from the paper guide surface to the pressure roller most remote from the guide surface is selected so as to be no more than one-half of the minimum width of paper intended for use with the inventive transport device.

This structural arrangement of elements provides a number of operating advantages. For example, since the recording medium is guided laterally along an edge of the paper, deviations in the recording medium width from its nominal dimensions have no influence on the position of the recording medium in the device. Similarly, different widths of recording media can be accomodated without having to effect any adjustments, manual or otherwise, of the device; thus, any recording medium width from a minimum of 148 mm to a maximum of 250 mm, by way of example, can be employed in one and the same device. In addition, a wide range of different or varying thicknesses of recording media can readily be used; paper having a basis weight of between 60 and 120 g/m$^2$, for example, can be transported without any problem or the need for separate time-consuming adjustments. A further advantage is that only minimal demands are placed on the operator of the device with respect to insertion of the recording medium, since a skewed or incorrectly or obliquely inserted recording medium or sheet will automatically become properly aligned and reach the desired position after advancing through a relatively short transport path.

Thus, the device of the present invention is of great operational simplicity and reliability and, in addition, provides an economical and technically compact solution to the problem of paper sheet transport since the alignment of the recording medium is obtained not by the inclusion of additional parts but by an advantageous structural arrangement of elements. The inventive device is furthermore suitable for both planar and non-planar transport units. Additional advantages, such as enhanced paper or media transport, also result from the fact that, for the entire permissible range of recording media widths, all of the pressure rollers are maintained in contact with the recording medium. The inventive device, moreover, is suitable for and will readily accomodate both (i.e. forward and reverse) directions of recording medium transport. And, finally, the pressure rollers of the transport device of the invention need not be provided with, for example, an expensive or otherwise specialized surface layer; relatively inexpensive rotary or molded plastic parts can be employed.

A further improvement in accordance with the invention is obtained by predeterminedly dimensioning certain elements of the transport device. It is, more particularly, preferred in this regard that there is a substantial correspondence of the distance between the paper guide surface and the pressure roller most remote from the guide surface, on the one hand, with the guide surface dimensions as measured from a contact line of the pressure rollers and friction roll to that point along the guide surface at which contact between a transported paper sheet and the guide surface terminates or ceases. This guide surface dimensioning represents the result of practical tests and can not, therefore, be readily discovered.

In another advantageous feature of the invention, the guide surface may be located or defined on a frame or machine wall in which the supporting shaft of the friction roll is rotatably mounted.

In one practical and currently contemplated field of use for the invention, the friction roll and the cylindrical pressure rollers provided on one longitudinally-offset side thereof may be proximately associated with a printing platen of a printer.

In accordance with another aspect of the invention, the several pressure rollers of the longitudinally-offset group thereof provide a substantially uniform pressing force against the friction roll and a recording medium interposed for transport between the friction roll and pressing rollers. This advantageous feature is realized by swingably mounting each of the pressure rollers by means of pivot shafts on spring-loaded swing arms. In a most basic form of the inventive transport device, the pressure rollers are arranged so as to lie along a straight axis which extends substantially parallel to the elongated friction roll shaft.

In another structural feature of the invention, the first pressure roll—i.e. that one of the pressure rolls disposed closest to the paper guide surface—is located at a minimum spacing or distance, from the guide surface, that corresponds approximately to the distance between the near end of the elongated friction roll and the guide surface.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements throughout the several views:

FIG. 1 is an end view of a paper transport device constructed in accordance with the present invention, depicting a friction roll, pressure rollers and an associated printing platen;

FIG. 2 is a longitudinal section taken along the lines II—II in FIG. 1.

DETAILED DESCRIPTION OF THE PREFERRED EMBODIMENTS

Figure 3:
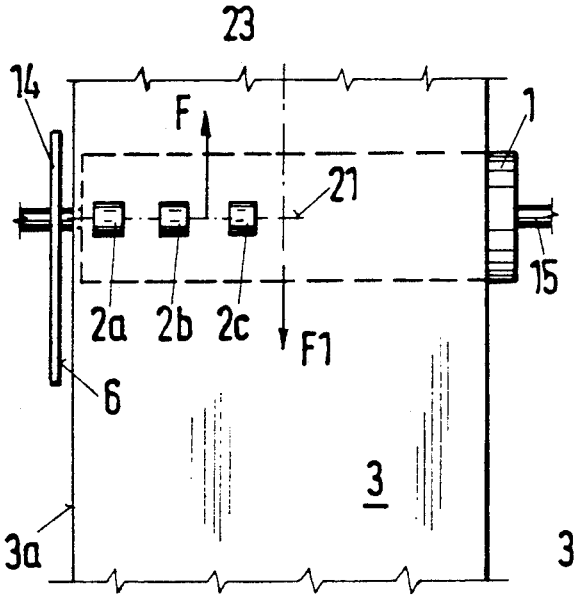
FIGS. 3 to 6 are top plan views of the inventive paper transport device, sequentially illustrating the feeding and transport of a recording medium from introduction of the sheet through its final positioning in accordance with the invention.

Structural details of a currently preferred embodiment of a paper or recording medium transport device constructed in accordance with the present invention are illustrated in FIGS. 1 and 2. The inventive device is there seen to include a rotatably mounted and driven elongated friction roll 1 and a plurality of idling pressure rollers 2*a*, 2*b*, 2*c* which are arranged on and along a portion of the periphery of the friction roll 1. In use, a recording medium 3—such as individual sheets or webs of paper or the like—is guided for transport between the friction roll 1 and the pressure rollers 2*a*, 2*b*, 2*c*.

The friction roll 1 has a first end 4 (on its left side in FIG. 2) and an axis 5 about which the roll 1 is rotatably driven. Associated with the friction roll axis 5 is a guide surface 6 along which, as seen in FIG. 2, a side or lateral edge 3*a* of the transported paper sheet or recording medium 3 is guided. The pressure rollers 2*a*, 2*b*, 2*c* are longitudinally-offset—i.e. arranged off-center with respect to the length 7 of the friction roll 1—on that side or portion of the roll 1 located closest to the guide surface 6. That portion 8 of the friction roll length which is disposed remote from the guide surface 6 is, on the other hand, free of such pressure rollers 2*a*, 2*b*, 2*c*. The pressure roll 2*c* most remote from the guide surface 6 is spaced from the guide surface by a distance 10 of no more than one-half of the minimum width 9 of a recording medium 3 that is intended for use with the transport device of the invention. Thus, the minimum width 9 of recording medium 3 is at least twice the distance 10 from the guide surface 6 to the far edge of the last pressure roller 2c.

In addition, the guide surface 6 against which the edge 3a of the recording medium 3 rests during transport, as measured from a contact line 11 of all of the pressure rollers 2a, 2b, 2c (FIG. 1) with the friction roll 1, on the one hand, to the end 12 of the guide surface 6 at which contact with a transported recording medium ceases, on the other, is dimensioned so as to be approximately equal to the distance 13 between the guide surface 6 and that pressure roller (2c) located most remote from the guide surface.

In a preferred construction, the guide surface 6 is formed by or as a part of a frame or machine wall 14 in which a friction roll shaft 15, with or about which the friction roll 1 is rotatable, is mounted for rotation concentric with the friction roll axis 5.

The pressure rollers 2a, 2b, 2c are advantageously cylindrical and, together with the friction roll 1, may be associated with a proximately-located printing platen 16 of a printer such, for example, as a dot-matrix or daisy-wheel printer.

The recording media 3, which may be within a range of thicknesses, are pressingly acted upon by the pressure rollers 2a, 2b, 2c. The pressure rollers are mounted for idling rotation on preferably individual pivot shafts 17, the shafts 17 being carried for rotation on pivoting swing arms 18 under the urgency of springs 19. Each spring 19 includes a first spring leg 19a that rests against a frame part 20 and a second spring leg 19b maintained in abutment with the respective pressure roller shaft 17.

In the embodiment of the invention herein disclosed and illustrated in the Figures, all of the several pressure rollers 2a, 2b, 2c are arranged on and along a straight axis 21 which extends substantially parallel to the friction roll shaft 15. Nevertheless, a relatively stepped arrangement of the pressure rollers is also within the intended scope and contemplation of the invention.

In another, preferred aspect of the inventive device the first pressure roller 2a—i.e. the pressure roller which is located closest to the guide surface 6—is located at a minimum distance 27 from the guide surface 6, the minimum distance 27 corresponding approximately to the spacing or distance 22 between the friction-roll end 4 and the guide surface 6.

Figure 4:
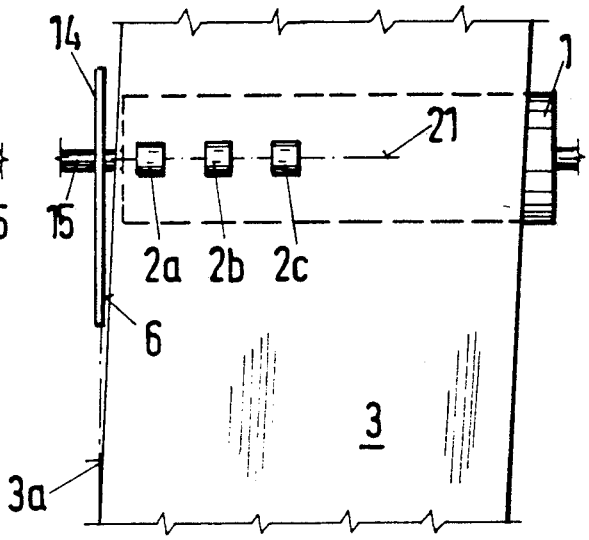

With reference now to FIGS. 3 to 6, the main portion of the frictional forces present between the friction roll 1 and the recording medium 3 are produced below the longitudinally-offset pressure rollers 2a, 2b, 2c (FIGS. 3 to 6). Accordingly, the drive force "F" resulting therefrom acts not in the laterally-defined center or middle 23 of the transported recording medium 3 but, rather, between the middle 23 and the guide surface 6—i.e. in the region of the three pressure rollers 2a, 2b, 2c. The reversely-directed or opposition force of reaction F1 upon acceleration of the recording medium acts, however, at or in the middle 23 of the recording medium (FIG. 3). Thus, since the drive force F and the oppositely-directed force of reaction F1 are relatively offset from each other, a moment of rotation is produced as the recording medium 3 is transported whereby a recording medium 3 that has not initially been inserted into the transport device in proper alignment and/or position against the guide surface 6 is twisted slightly on the friction roll 1. As a consequence, with continued transport the recording medium 3 becomes oriented somewhat obliquely on the friction roll 1 (FIG. 4). Upon further transport, this oblique orientation or position results in some lateral travel or movement of the recording medium 3 in the direction of the guide surface 6.

Figure 5:
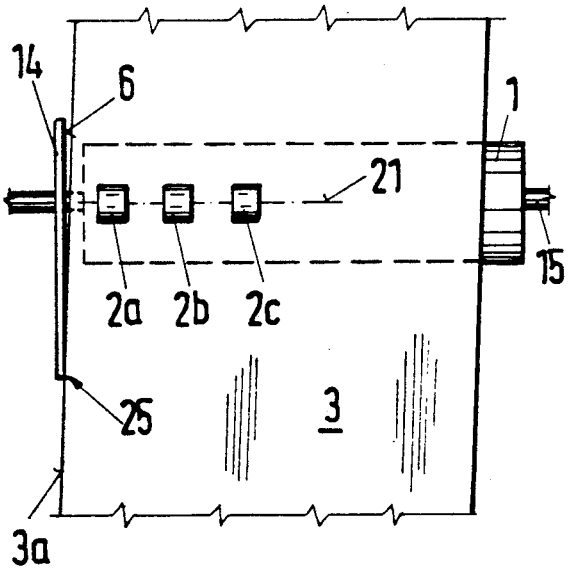
Figure 6:
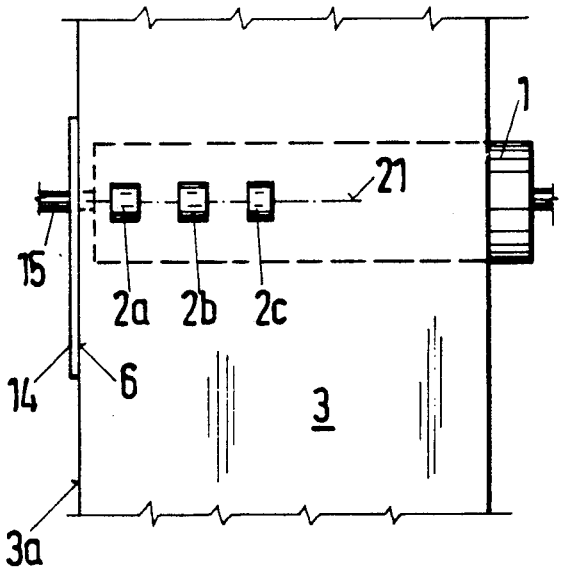

On reaching the guide surface 6, the obliquely-oriented recording medium 3 initially contacts the guide surface 6 only at a point 25 (FIG. 5). The lateral component of movement, with further transport of the medium 3, then effects a linear contact of the printing support edge 3a with the guide surface 6, as a result of which the recording medium 3 then lies at a right angle to the friction-roll axis 5 wherein the lateral component of movement is zero. As illustrated in FIG. 6, the recording medium 3 has thus reached the desired position of properly aligned transport linearly along and in lateral edge abutment with the guide surface 6. Should the lateral edge 3a of the recording medium 3, for any reason, leave or separate from the guide surface 6, then the straightening process is automatically repeated in the sequence shown in FIGS. 3 to 6 and described hereinabove.

Where the guide surface 6 is dimensioned so as have sufficient length both in front of and behind the pressure rollers 2a, 2b, 2c, the transport device of the invention may be employed for the transport of recording media in both forward and reverse directions of advancement. The friction roll 1 may also be advantageously constructed with a rubber covering or layer 26, such as is indicated in FIG. 2, so as to increase the frictional forces between the recording medium 3 and the periphery of the friction roll 1.

While there have been shown and described and pointed out fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A device for the transport of paper sheets of varying or different widths and thicknesses, the sheets having a lateral edge (3a) and a minimum sheet width, comprising:

an elongated friction roll (1) mounted for driven rotation about an axis (5) and having a length (7), a circumferential periphery and a first end (4);

a plurality of pressure rollers (2a, 2b, 2c) rotatably disposed for spring-urged abutment with the friction roll periphery and with a paper sheet interposed for transport between said pressure rollers and friction roll periphery; and a guide surface (6) for the lateral edge (3a) of a paper sheet being transported by the device, said guide surface extending substantially perpendicular to the friction roll axis (5) and proximate said first end (4) of the friction roll;

all of said plural pressure rollers (2a, 2b, 2c) being disposed longitudinally-offset along said friction roller (1) on a longitudinal first portion of the friction roller proximate said guide surface (6) and including said first end (4) so that a second longitudinal portion of the friction roller remote from said guide surface (6) and first end (4) is free of said pressure rollers, and the pressure roller (2c) disposed most remote from said guide surface (6) being spaced from said guide surface by a first distance no greater than one-half of the minimum sheet width.

2. A device in accordance with claim 1, further comprising a contact line (11) defined along said abutment of the pressure rollers (2a, 2b, 2c) with said friction roll (1), and a contact end (12) defined on said guide surface (6) and at which the lateral edge (3a) of a transported sheet ceases contact with the guide surface, and wherein said guide surface (6) is predeterminately dimensioned so as to define a second distance of transported sheet lateral edge contact with the guide surface from said contact line (11) to said contact end (12), said second distance being substantially equal to said first distance.

3. A device in accordance with claim 1, further comprising a shaft (15) of said friction roll (1) and a machine wall (14), said guide surface (6) being defined on said machine wall and said friction roll shaft (15) being mounted for rotation on said machine wall.

4. A device in accordance with claim 2, further comprising a shaft (15) of said friction roll (1) and a machine wall (14), said guide surface (6) being defined on said machine wall and said friction roll shaft (15) being mounted for rotation on said machine wall.

5. A device in accordance with claim 1, further comprising a printing platen (16) disposed proximate said friction roll (1) and pressure rollers (2a, 2b, 2c) for printing on a transported sheet.

6. A device in accordance with claim 2, further comprising a printing platen (16) disposed proximate said friction roll (1) and pressure rollers (2a, 2b, 2c) for printing on a transported sheet.

7. A device in accordance with claim 4, further comprising a printing platen (16) disposed proximate said friction roll (1) and pressure rollers (2a, 2b, 2c) for printing on a transported sheet.

8. A device in accordance with claim 1, further comprising, for each said pressure roller (2a, 2b, 2c) a pivot shaft (17) on which the pressure roller is carried for rotation and a spring-urged swing arm (18) on which said pivot shaft is carried.

9. A device in accordance with claim 2, further comprising, for each said pressure roller (2a, 2b, 2c), a pivot shaft (17) on which the pressure roller is carried for rotation and a spring-urged swing arm (18) on which said pivot shaft is carried.

10. A device in accordance with claim 3, further comprising, for each said pressure roller (2a, 2b, 2c), a pivot shaft (17) on which the pressure roller is carried for rotation and a spring-urged swing arm (18) on which said pivot shaft is carried.

11. A device in accordance with claim 5, further comprising, for each said pressure roller (2a, 2b, 2c), a pivot shaft (17) on which the pressure roller is carried for rotation and a spring-urged swing arm (18) on which said pivot shaft is carried.

12. A device in accordance with claim 1, wherein said plural pressure rollers (2a, 2b, 2c) lie along a substantially straight axis (21) that extends substantially parallel to the friction roll shaft (15).

13. A device in accordance with claim 2, wherein said plural pressure rollers (2a, 2b, 2c) lie along a substantially straight axis (21) that extends substantially parallel to the friction roll shaft (15).

14. A device in accordance with claim 3, wherein said plural pressure rollers (2a, 2b, 2c) lie along a substantially straight axis (21) that extends substantially parallel to the friction roll shaft (15).

15. A device in accordance with claim 5, wherein said plural pressure rollers (2a, 2b, 2c) lie along a substantially straight axis (21) that extends substantially parallel to the friction roll shaft (15).

16. A device in accordance with claim 8, wherein said plural pressure rollers (2a, 2b, 2c) lie along a substantially straight axis (21) that extends substantially parallel to the friction roll shaft (15).

17. A device in accordance with claim 1, further comprising a second distance (22) defined from said guide surface (6) to said first end (4) of the friction roll (1), and a third distance (27) defined from said guide surface to the pressure roller (2a) disposed closest to said guide surface, said third distance (27) being, at a minimum, substantially equal to said second distance (22).

18. A device in accordance with claim 2, further comprising a third distance (22) defined from said guide surface (6) to said first end (4) of the friction roll (1), and a fourth distance (27) defined from said guide surface to the pressure roller (2a) disposed closest to said guide surface, said fourth distance (27) being, at a minimum, substantially equal to said third distance (22).

19. A device in accordance with claim 3, further comprising a second distance (22) defined from said guide surface (6) to said first end (4) of the friction roll (1), and a third distance (27) defined from said guide surface to the pressure roller (2a) disposed closest to said guide surface, said third distance (27) being, at a minimum, substantially equal to said second distance (22).

20. A device in accordance with claim 5, further comprising a second distance (22) defined from said guide surface (6) to said first end (4) of the friction roll (1), and a third distance (27) defined from said guide surface to the pressure roller (2a) disposed closest to said guide surface, said third distance (27) being, at a minimum, substantially equal to said second distance (22).

21. A device in accordance with claim 8, further comprising a second distance (22) defined from said guide surface (6) to said first end (4) of the friction roll (1), and a third distance (27) defined from said guide surface to the pressure roller (2a) disposed closest to said guide surface, said third distance (27) being, at a minimum, substantially equal to said second distance (22).

22. A device in accordance with claim 12, further comprising a second distance (22) defined from said guide surface (6) to said first end (4) of the friction roll (1), and a third distance (27) defined from said guide surface to the pressure roller (2a) disposed closest to said guide surface, said third distance (27) being, at a minimum, substantially equal to said second distance (22).

* * * * *